United States Patent [19]

Fukushima et al.

[11] Patent Number: 4,905,429

[45] Date of Patent: Mar. 6, 1990

[54] DEVICE FOR FILLING UP OF RECESS LEFT IN CONCRETE WALL AFTER REMOVAL

[75] Inventors: Takuo Fukushima, Yachiyo; Yasumasa Hayashida, Ageo; Hiroto Gomi, Chiba; Kuniharu Kikuma, Funabashi, all of Japan

[73] Assignee: Denka Kogyo Kabushiki Kaisha, Tokyo, Japan

[21] Appl. No.: 353,678

[22] PCT Filed: Nov. 11, 1987

[86] PCT No.: PCT/JP87/00870

§ 371 Date: Apr. 28, 1989

§ 102(e) Date: Apr. 28, 1989

[87] PCT Pub. No.: WO89/04412

PCT Pub. Date: May 18, 1989

[51] Int. Cl.[4] ..... E04G 23/02

[52] U.S. Cl. ..... 52/127.5; 52/514; 52/173 R

[58] Field of Search ..... 52/514, 127.5, 127.7, 52/173, 741, 743–745, 711; 249/40, 210, 213, 219.2, 205

[56] References Cited

U.S. PATENT DOCUMENTS

| | | | |
|---|---|---|---|
| 3,889,436 | 6/1975 | Elliott | 52/514 |
| 4,016,696 | 4/1977 | Mess et al. | 52/514 |
| 4,120,128 | 10/1978 | Pauls | 52/173 R |
| 4,141,190 | 2/1979 | Shimada | 52/711 |
| 4,301,629 | 11/1981 | Far | 52/514 |
| 4,512,123 | 4/1985 | Fischer | 52/173 R |

*Primary Examiner*—John E. Murtagh
*Assistant Examiner*—Caroline D. Dennison
*Attorney, Agent, or Firm*—Frishauf, Holtz, Goodman & Woodward

[57] ABSTRACT

The present invention relates to a device for filling up a recess left in a concrete wall after removal of a separator terminal, the device comprising a main body including a circumferential step formed around its outer periphery at a longitudinal intermediate location so that the circumferential step defines a diameter-reduced portion and a diameter-enlarged portion of the main body, a threaded hole centrally formed and axially extending in an end surface of the diameter-reduced portion to be engaged with a threaded end of the separator, tool receiving apertures formed in an end surface of the diameter-enlarged portion and in elastic water-swollen rubber cylinder put around the diameter-reduced portion so that an outer periphery of said cylinder is tapered towards the end surface of the diameter-reduced portion and an end surface of the cylinder looking towards the end surface of the diameter-enlarged portion bears against the step of the main body while the end surface of the cylinder looking towards the end surface of the diameter-reduced portion extends at least to the end surface of the diameter-reduced portion.

3 Claims, 3 Drawing Sheets

DEVICE FOR FILLING UP OF RECESS LEFT IN CONCRETE WALL AFTER REMOVAL

BACKGROUND OF THE INVENTION

1. Field of the Invention

The present invention relates to a device for filling up a recess left in a concrete wall after removal of a separator terminal when molds are disassembled in construction of the concrete wall and, more particularly, to such device comprising a main body and an elastic water-swollen rubber cylindrical component fixed on said main body so that said elastic rubber cylindrical component is water-swollen to perfectly fill up said recess for a high water sealing effect.

2. Description of the Prior Art

In constructing the above-mentioned concrete structure such as the concrete wall, the separator is usually used to hold each pair of molds opposed to each other at a predetermined distance and such separator is left embedded in the concrete structure after completion of this structure. More particularly, each separator is provided on its opposite ends with separator terminals, respectively, and these separator terminals are removed when the molds are disassembled upon completion of the construction. This results in formation of a recess in the concrete wall in a region which has been occupied by each of the separator terminals. Such recess must be filled up in a suitable manner for water-sealing effect.

One well-known device for filling up the above-mentioned recess has already been disclosed in Utility Model Publication No. 56-1843.

According to the invention disclosed by this Utility Model Publication, an annular packing made of rubber, synthetic resin sponge, rubber immersed synthetic resin sponge or other plastic material is placed around the threaded and of the separator projecting into the recess left in the concrete wall after the separator terminal has been removed and then a flanged cap is hammer-driven or pressed against said packing so that a hole of said flanged cap tightly receives said threaded end of the separator. In this way, the packing is held between a bottom surface of the recess and the flange of the cap and said packing water-seals the projecting end of the separator.

However, this device of prior art is accompanied with problems as follow:

(1) No adequate area is available along which the packing is contact with the inner surface of the recess.

(2) Upon contraction as the years go, there is developed a gap between the inner surface of the recess and the packing.

With a consequence, the packing can not provide a satisfactory water-sealing effect.

SUMMARY OF THE INVENTION

A principal object of the present invention is to provide a device for filling up a recess left in the concrete wall after removal of the separator terminal with a high water-sealing effect and thereby to solve the above-mentioned problems.

Another object of the present invention is to provide said device which can be constructed from relatively few parts in a simple structure, easily manufactured at a low cost and easily manipulated.

The present invention provides a device for filling up a recess left in a concrete wall after removal of a separator terminal, said device comprising a main body including a circumferential step formed around its outer periphery at a longitudinal intermediate location so that said circumferential step defines a diameter-reduced portion and a diameter-enlarged portion of said main body, a threaded hole centrally formed and axially extending in an end surface of said diameter-reduced portion to be engaged with a threaded end of the separator, tool receiving means formed in an end surface of said diameter-enlarged portion and an elastic water-swollen rubber cylinder put around said diameter-reduced portion so that an outer periphery of said cylinder is tapered towards the end surface of said diameter-reduced portion and an end surface of said cylinder looking towards the end surface of said diameter-enlarged portion bears against said step of said main body while the end surface of said cylinder looking towards the end surface of said diameter-reduced portion extends at least to said end surface of said diameter-reduced portion.

To assure that the end surface of said elastic water-swollen rubber cylinder looking towards the end surface of said diameter-reduced portion extends at least to said end surface of said diameter-reduced portion, said elastic water-swollen rubber cylinder may be so arranged that the end surface thereof looking towards the end surface of said diameter-reduced portion reduced portion or coincides with said end surface of said diameter-reduced portion.

BRIEF DESCRIPTION OF THE DRAWINGS

FIGS. 5 through 10 are partial longitudinal sectional views illustrating other embodiments, wherein FIG. 5 illustrates a second embodiment, FIG. 6 illustrates a third embodiment, FIG. 7 illustrates a fourth embodiment, FIG. 8 illustrates a fifth embodiment, FIG. 9 illustrates a sixth embodiment and FIG. 10 illustrates a seventh embodiment;

DETAILED DESCRIPTION OF THE INVENTION

Figure 1:
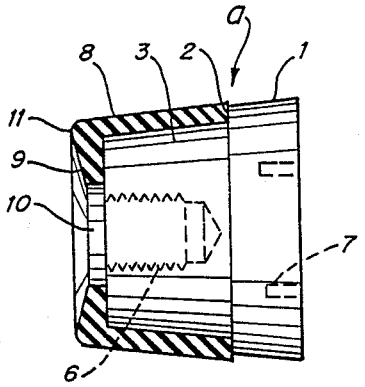
FIG. 1 is a partial longitudinal sectional view illustrating a device constructed in accordance with a first embodiment of the present invention.
Figure 2:
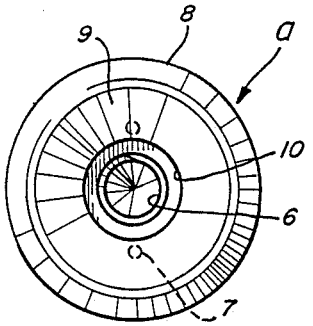
FIG. 2 is a side view illustrating the same.
Figure 3:
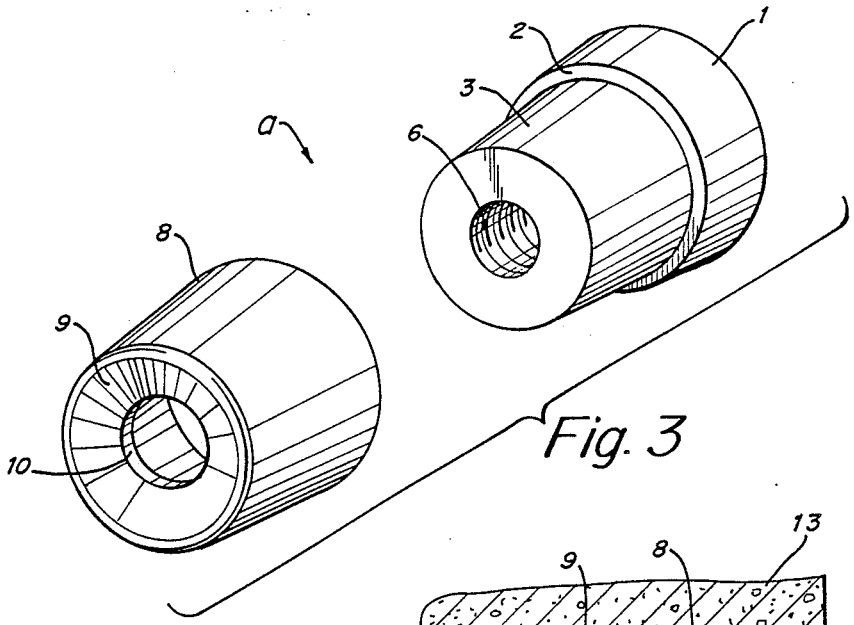
FIG. 3 is a disassembled perspective view illustrating the same.

The invention will be initially described with respect to the first embodiment as illustrated by FIGS. 1 through 4. A reference a designates a device for filling and a reference 1 designates a main body of said device a made of synthetic resin and shaped in a truncated cone. Said main body 1 has a step 2 circumferentially formed around its outer periphery, by which said main body 1 is divided into a diameter-reduced portion 3 and a diameter-enlarged portion. Said diameter-reduced portion 3 is provided centrally in its end surface with a threaded hole 6 while said diameter-enlarged portion is provided in its end surface with tool receiving means 7 consisting of upper and lower holes. An elastic water-swollen rubber cylindrical component 8 is rotatably mounted on said diameter-reduced portion 3 of the main body 1. This cylindrical component 8 includes a bottom plate having a central opening 10 and peripheral edge 11 projecting axially forwards. After mounted on the main body 1, said water-swollen rubber cylindrical component 8 has its bottom plate 9 bearing against the end surface of the diameter-reduced portion 3, its end surface looking towards the end surface of the diameter-enlarged portion bearing against the step 2 of the main body 1 and its outer cylindrical surface slightly projecting radially outwards with respect to the main body 1, thus constituting the device a for filling up of the invention. Said diameter-reduced portion 3 of the main body 1 and said water-swollen rubber cylindrical component 8 are; as shown, tapered towards the end surface of said diameter-reduced portion 3.

Examples of the water-swelling waterstop material to be used for the water-swelling waterstop rings 3, 7 and 15 include acryl, vinyl and inorganic water-swelling resins. It is particularly preferable to use a flexible material containing water-swelling polyurethane which comprises a mixture of a water-swelling polyurethane resin and, for example, natural, synthetic or reclaimed rubber, therefor.

Such a flexible material as described above may be obtained by kneading one or more polyether polyols of the following general formula:

$$R[(OR)n]P$$

wherein

R represents a polyhydric alcohol residue;

(OR) represents a polyoxyalkylene chain comprising oxyalkylene groups each having an oxyethylene group and an alkylene group carrying three or four carbon atoms, provided that the content of the oxyethylene groups amounts to 20 to 100% of the total molecular weight;

n is a number corresponding to the degree of polymerization of the oxyalkylene groups and giving a hydroxyl group equivalent of 200 to 2500; and p is a number of 2 to 8, preferably 2 to 4;

together with urethane polymer(s) having polyisocyanate groups, a crosslinking agent and the rubber as defined above followed by curing.

Examples of said polyhydric alcohol include dihydric alcohols such as ethylene glycol and propylene glycol; trihydric alcohols such as glycerol and trimethylolpropane; tetrahydric alcohols such as erythritol and pentaerythritol; pentahydric alcohols such as arabitol and xylitol; and hexahydric alcohols such as sorbitol and mannitol.

Said polyether plyols may be obtained by adding alkylene oxide(s) to these polyhydric alcohols in such a manner as to give the desired molecular weight. Either random or block addition may be employed therefor. When the content of the oxyethylene groups is less than 20%, the resulting material is unsatisfactory as a water-stop material. Any polyisocyanates may be employed. The content of the terminal isocyanate groups may be 1 to 12%, preferably 2 to 7%.

Examples of said crosslinking agent include polyols and polyamines each carrying two to six active hydrogen atoms per molecule and has an average molecular weight per active hydrogen atom of 30 to 15000, for example, low-molecular weight polyols, addition polymers of low-molecular weight polyols and alkylene oxides and addition polymers of low-molecular weight polyamines and alkylene oxides, as well as mixtures thereof.

It is preferable that the flexible material as described above contains 20 to 800 parts of the water-swelling polyurethane resin per 100 parts of the rubber.

Other examples of preferable flexible materials are those obtained by further adding hydraulic material(s) to a composition comprising said water-swelling polyurethane resin and rubber. Examples of available hydraulic materials include Portland cement, blast furnace cement, colloidal cement and gypsum. It is preferable to employ a curing accelerator for cement comprising calcium aluminate simultaneously therewith. A flexible material comprising such a hydraulic material has an advantage that it shows little shrinkage when dried. It is preferable that the hydraulic material is blended in an amount of 20 to 30 parts per 100 parts of the mixture of the water-swelling polyurethane and rubber.

The above flexible material may further contain appropriate water-absorbing material(s). Examples of the water-absorbing materials include those mainly comprising an $\alpha,\beta$-unsaturated compound, which carries one or more carboxyl groups or those capable of being derived thereto such as carboxyl, carboxylate, carboxylic limide, carboxylic amide or carboxylic anhydride groups per molecule, and optionally polymerized with other $\alpha,\beta$-unsaturated compound(s) and/or modified with isocyanate(s).

Examples of such a water-absorbing resin include conventional water-absorbing polymers such as starch/acrylic acid graft copolymer, a salt of styrene/maleic anhydride copolymer, crosslinked poly(sodium acrylate), vinyl ester/ethylenically unsaturated carboxylic acids, and saponified products of derivatives thereof.

The flexible material may be further vulcanized with the use of a crosslinking agent such as sulfur.

It is preferable that the composition of the flexible material may be controlled in such a manner as to give a water-swelling ratio of the resulting molded article of 10 to 350%, still preferably 40 to 250%.

Figure 4:
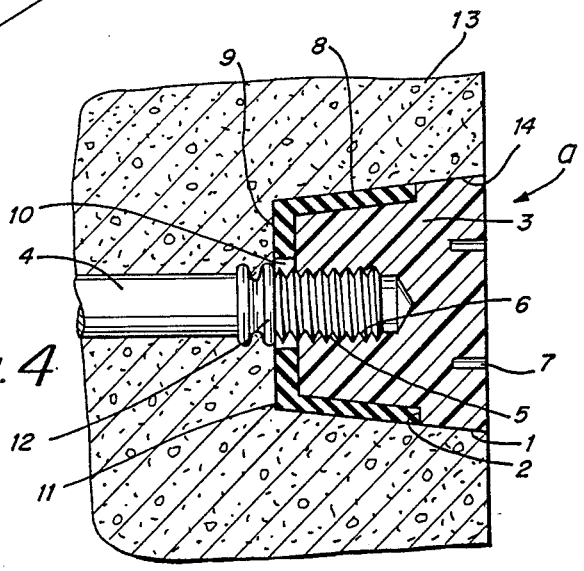
FIG. 4 is a longitudinal sectional view illustrating said device as filling up a recess left in a concrete wall after removal of a separator terminal.

FIG. 4 is a longitudinal sectional view illustrating said device as filling up a recess left in a concrete wall after removal of a separator terminal. A reference 4 designates a separator as embedded in a concrete wall 13. Said separator 4 is provided on its opposite ends with threads 5 terminating in stoppers 12, respectively.

A reference 14 designates a recess which has been occupied by the separator terminal having a head shaped in a truncated cone and left in the concrete wall 13 after removal of such separator terminal.

It should be understood here that the expression "concrete wall" covers the walls of various concrete structures so far as they are constructed with use of the separators.

Now it will be described how to use the device of the present invention.

After removal of the molds and the separator terminals upon completion of the concrete wall 13 by placing concrete, the recesses are left in the concrete wall at positions corresponding to the respective separator terminals. The device a of the present invention is to fill up each of these recesses 14. To achieve it, the device a is inserted, with its diameter-reduced portion ahead, into the recess 14 so that the threaded hole 6 is aligned contact with the threaded end of the separator 4, then a suitable tool is engaged in the tool receiving means 7 and thereby the main body 1 is rotated so as to engage the threaded hole 6 thereof with the thread 5 of the separator 4. In a consequence, as seen in FIG. 4, the main body 1 of the device a is threaded on the end of the separator 4 and secured within the recess 14. The bottom plate 9 of the elastic water-swollen rubber cylindrical component 18 is tightly pressed along its projecting edge 11 particularly against the bottom surface of the recess 14 as the main body 1 is threaded in while said elastic water-swollen rubber cylindrical component 8 is compressed between the bottom surface of the recess 14 and the step 2 of the main body 1 and thereby radially expanded so as to be pressed against the peripheral surfaces of both the recess 14 and the main body 1. In this manner, the device a perfectly fills up the recess 14.

With a consequence, any quantity of rainwater or like penetrating through the surface of the wall 13 into a gap defined between the recess 14 and the peripheral surface of the main body 1 of the device a is dammed up by the elastic water-swollen rubber cylindrical component 8 against further penetration into the wall 13.

More specifically, when any quantity of rainwater or like reaches said gap defined between the recess 14 and the peripheral surface of the main body 1, said elastic water-swollen rubber cylindrical component 8 is so swollen that the opposite end surfaces thereof are pressed against the bottom surface of the recess 14 and the step 2 of the main body 1, respectively, and thereby its axial swelling is prevented. As a result, said elastic water-swollen rubber cylindrical component 8 is now radially swollen tightly against the peripheral surfaces of both the recess 14 and the main body 1 and reliably fills up the gap defined between the recess 14 and the device a, assisting the device a to prevent the quantity of water present in said gap from further penetrating into the wall 13.

FIGS. 5 through 10 illustrate other embodiments of said device a.

Figure 5:
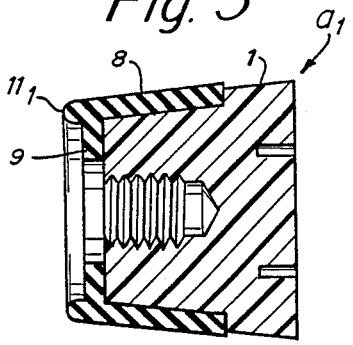

In the device $a_1$ of FIG. 5 constructed as the second embodiment, the projecting edge 11 formed on the bottom plate 9 of the elastic water-swollen rubber cylindrical component 8 as the part of the device a is replaced by an annular ridge $\mathbf{11}_1$ extending along the peripheral edge on the outer side of the bottom plate 9.

Figure 6:
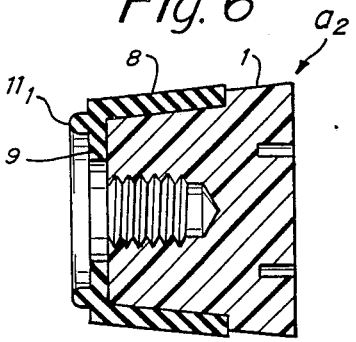

The device $a_2$ of FIG. 6 constructed as the third embodiment differs from the device $a_1$ as the second embodiment in that said annular ridge $\mathbf{11}_1$ of the elastic water-swollen rubber cylindrical component 8 is disposed, instead of along the peripheral edge, along a circle concentric with said peripheral edge and having a radius smaller than that of said peripheral edge on the outer side of the bottom plate 9.

Figure 7:
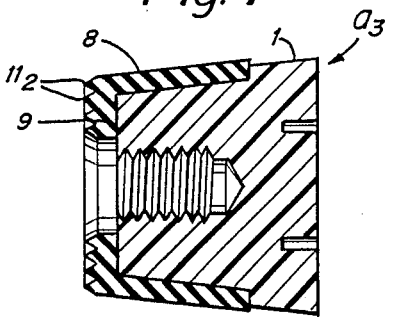

In the device $a_3$ of FIG. 7 constructed as the fourth embodiment, the projecting edge 11 formed on the bottom plate 9 of the elastic water-swollen rubber cylindrical component 8 is replaced by a plurality of concentric annular ridges $\mathbf{11}_2$ each having a triangular cross-section extending along the peripheral edge on the outer side of the bottom plate 9.

Figure 8:
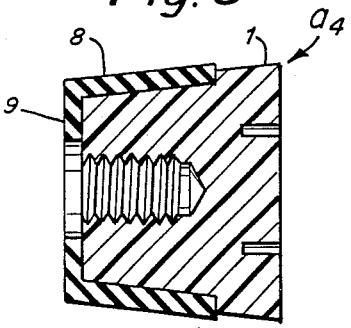

In the device $a_4$ of FIG. 8 constructed as the fifth embodiment, the bottom plate 9 of the elastic water-swollen rubber cylindrical component 8 is flat without the projecting edge or like.

Figure 9:
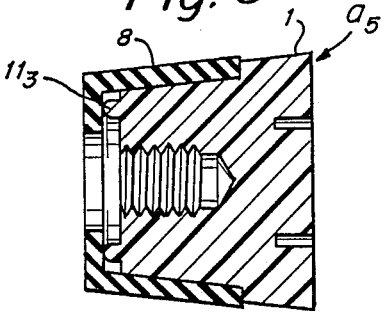

The device $a_5$ of FIG. 9 constructed as the sixth embodiment differs from the device $a_4$ as the fifth embodiment in that there is provided an annular ridge $\mathbf{11}_3$ on the diameter-reduced end surface of the main body 1 in said fifth embodiment.

Figure 10:
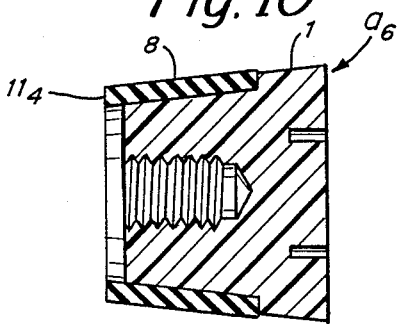

The device $a_6$ of FIG. 10 constructed as the seventh embodiment differs from the device $a_4$ as the fifth embodiment in that the bottom plate 9 is removed from the elastic water-swollen rubber cylindrical component 8 of said fifth embodiment and the diameter-reduced end of the cylindrical component extends forwards beyond the diameter-reduced end surface of the main body 1 so as to form a projection $\mathbf{11}_4$.

These devices $a_1$, $a_2$, $a_3$, $a_4$, $a_5$ and $a_6$ constructed as the second through seventh embodiments function in the manner similar to the device a as the first embodiment.

With the above-mentioned devices a, $a_1$, $a_2$, $a_3$, $a_4$, $a_5$ and $a_6$, the diameter-reduced end surface of the elastic water-swollen rubber cylindrical component 8 can be pressed against the bottom surface of the recess in the annular line contact mode as the main body 1 of each device is threaded on the end 5 of the separator 4. Owing to such annular line contact, the diameter-reduced end surface of the device can be tightly pressed against the bottom surface of the recess 14 even when the main body 1 is rotated with a relatively small force.

Figure 11:
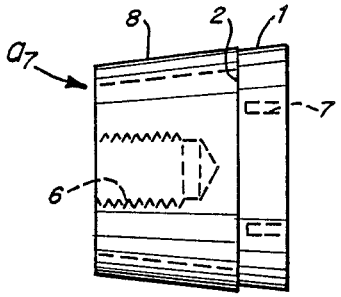
FIG. 11 is a frontal view illustrating a device constructed in accordance with a eighth embodiment of the present invention.
Figure 12:
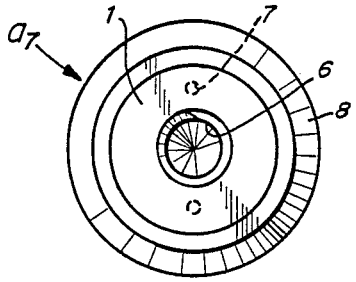
FIG. 12 is a side view illustrating the same.
Figure 13:
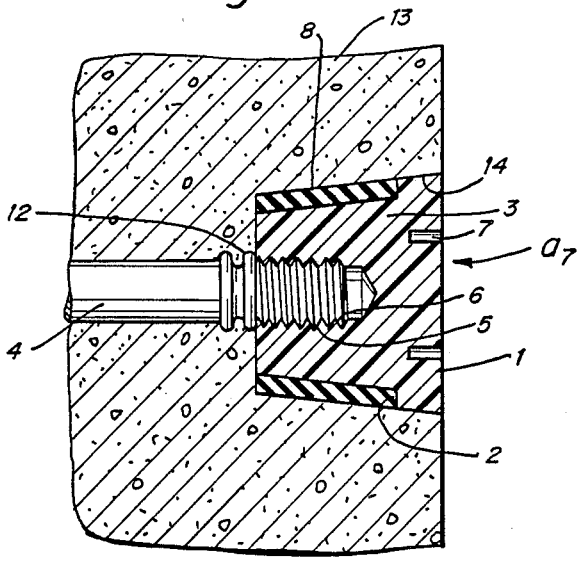
FIG. 13 is a longitudinal sectional view illustrating said device as filling up a recess left in a concrete wall after removal of a separator terminal.

The device $a_7$ constructed in accordance with the eighth embodiment and illustrated by FIGS. 11 through 13 corresponds to the device a as the first embodiment in which the bottom plate 9 is removed from the elastic water-swollen rubber cylindrical component 8 so that the diameter-reduced end surface of said elastic water-swollen rubber cylindrical component 8 coincides with the diameter-reduced end surface of the main body 1.

This eighth embodiment is identical to the first embodiment in its operation and effect. Specifically, as seen in FIG. 13, the device $a_7$ secured within the recess 14 by threading the main body 1 on the end 5 of the separator 4 and the outer peripheral surface of the cylindrical component 8 is pressed against the inner peripheral surface of the recess 14 while the opposite end surfaces there of are pressed against the bottom surface of the recess 14 and the step 2 of the main body 1, respectively. In this manner, the device $a_7$ fills up the recess 14.

The device of the present invention for filling up the recess left in the concrete wall after removal of the separator terminal provides significant effects as follow:

(1) The feature that the device is threaded on the end of the separator by a suitable tool assures reliable and firm installation thereof, preventing the device from being displaced outwards and from falling off.

(2) The water-swollen rubber cylindrical component carried around the main body of the device is compressed between the bottom surface of the recess and the step of the main body threaded on the end of the separator and thereby radially expanded tightly against the peripheral surfaces of both the recess and the main body.

Therefore:

(a) The water-swollen rubbery cylindrical component is brought into contact with both the bottom surface and the peripheral surface of the recess over a sufficiently large area to achieve a significant water-sealing effect by said cylindrical component.

(b) Any quantity of rainwater or like penetrating through the wall surface into the gap defined between the peripheral surfaces of the recess and the main body is dammed up by the water-swollen rubber cylindrical component located outwardly of the main body against further penetration into the wall.

(c) When any quantity of rainwater or like penetrating into the gap between the peripheral surfaces of the recess and the main body reaches the water-swollen rubber cylindrical component, said cylindrical component is swollen, pressed at the opposite ends against the bottom surface of the recess and the step of the main body, respectively, and thereby prevented from being axially swollen. In consequence, the cylindrical component is radially swollen tightly against the peripheral surfaces of both the recess and the main body over a sufficiently large area to achieve a reliable sealing and thereby to further assure that any quantity of water present in the gap defined therebetween is prevented from further penetrating into the wall.

(3) With the water-swollen rubber cylindrical component so arranged that the one end bears against the step of the main body and the other end extends beyond the diameter-reduced end surface of said main body when mounted around said main body of the device, the water-swollen rubber cylindrical component is compressed between the bottom surface of the recess and the step of the main body as said main body of the device is threaded on the end of the separator. Thus, the cylindrical component is axially compressed and thereby forcibly expanded in the radial direction further tightly against the peripheral surfaces of both the recess and the main body.

(4) It is effectively avoided by the invention that rainwater or like penetrates through the wall surface, then through the gap defined between the recess and the device into the wall around the separator. Therefore:

(a) The separator is prevented from being rusted and thereby the durability of the concrete structure is improved.

(b) It is also effectively avoided that any quantity of rust containing water exudes over the wall surface and injures the aesthetic appearance of the wall surface.

(c) Relatively small number of parts can be easily assembled at a low cost into the device which can be, in turn, easily handled.

What is claimed is:

1. A device for filling up a recess left in a concrete wall after removal of a separator terminal, said device comprising a main body including a circumferential step formed around its outer periphery at a longitudinal intermediate location so that said circumferential step defines a diameter-reduced portion and a diameter-enlarged portion of said main body, a threaded hole centrally formed and axially extending in an end surface of said diameter-reduced portion to be engaged with a threaded end of the separator, tool receiving means formed in an end surface of said diameter-enlarged portion and an elastic water-swollen rubber cylinder mounted around said diameter-reduced portion so that an outer periphery of said cylinder is tapered towards the end surface of said diameter-reduced portion and an end surface of said cylinder looking towards the end surface of said diameter-enlarged portion bears against said step of said main body while the end surface of said cylinder looking towards the end surface of said diameter-reduced portion extends at least to said end surface of said diameter-reduced portion.

2. A device for filling up a recess left in a concrete wall after removal of a separator terminal as recited in claim 1, wherein the end surface of the water-swollen rubber cylinder looking towards the end surface of the diameter-reduced portion extends beyond said end surface of said diameter-reduced portion of the main body.

3. A device for filling up a recess left in a concrete wall after removal of a separator terminal as recited in claim 1, wherein the end surface of the water-swollen rubber cylinder looking towards the end surface of the diameter-reduced portion coincides with said end surface of said diameter-reduced portion of the main body.

* * * * *

UNITED STATES PATENT AND TRADEMARK OFFICE

CERTIFICATE OF CORRECTION

PATENT NO. : 4,905,429

DATED : March 6, 1990

INVENTOR(S) : FUKUSHIMA et al

It is certified that error appears in the above-identified patent and that said Letters Patent is hereby corrected as shown below:

Title page, Section [73] Assignee:

Change "Denka Kogyo Kabushiki Kaisha" to

--Asahi Denka Kogyo Kabushiki Kaisha--.

Signed and Sealed this

Eighteenth Day of August, 1992

*Attest:*

*Attesting Officer*

DOUGLAS B. COMER

*Acting Commissioner of Patents and Trademarks*